US006510903B2

(12) United States Patent
Fünfer

(10) Patent No.: US 6,510,903 B2
(45) Date of Patent: Jan. 28, 2003

(54) COMBINATION ELECTRICAL HAND-HELD TOOL

(75) Inventor: Josef Fünfer, Königsbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 6 days.

(21) Appl. No.: 09/899,446

(22) Filed: Jul. 5, 2001

(65) Prior Publication Data

US 2002/0003044 A1 Jan. 10, 2002

(30) Foreign Application Priority Data

Jul. 7, 2000 (DE) ..... 100 33 100

(51) Int. Cl.[7] ..... E02D 7/02
(52) U.S. Cl. ..... 173/48
(58) Field of Search ..... 173/48

(56) References Cited

U.S. PATENT DOCUMENTS 4,349,074 A * 9/1982 Ince ..... 173/48
4,627,627 A * 12/1986 Rohm ..... 173/48
6,192,996 B1 * 2/2001 Sakaguchi et al. ..... 173/48
6,223,833 B1 * 5/2001 Thurler et al. ..... 173/48

* cited by examiner

*Primary Examiner*—Anthony D. Stashick
(74) *Attorney, Agent, or Firm*—Sidley Austin Brown & Wood, LLP

(57) ABSTRACT

An electrical hand-held tool having a plurality of operational modes and including a tool spindle (1) rotatably supported in the tool housing (5) for rotation about a rotational axis (A), an outer sleeve (2) arranged coaxially with the tool spindle (1) and connected thereto for joint rotation therewith, a bolt (6) supported in the housing without a possibility of rotation relative thereto and displaceable in a direction transverse to the rotational axis (A) for engaging in at least one opining (3) provided in the sleeve (2) at least in one of the operational modes of the electrical tool, and a sliding sleeve (12) supported on a drive shaft (13) of the electrical tool and connected with the bolt (6) for displacing same in response to actuation of a mode selection switch (4).

6 Claims, 2 Drawing Sheets

COMBINATION ELECTRICAL HAND-HELD TOOL

BACKGROUND OF THE INVENTION

1. Field of the Invention

The present invention relates to a combination electrical hand-held tool, such as a combination hammer, with at least partial rotational movement of a working tool.

2. Description of the Prior Art

In combination electrical hand-held tools, one drive provides for both rotational and percussion movements, which permits switching, by using a manually actuatable mode selection switch connected with the drive, between different operational modes such as drilling, drilling and chiseling, and chiseling.

In one operational mode, e.g., chiseling, the transmission of a torque from a drive to working tool-receiving chuck is interrupted. As a result, the rotation of the chuck relative to the housing is prevented. The chuck, at that, usually can occupy more than one discrete angular positions relative to the housing.

U.S. Pat. No. 5,379,848 discloses a tool in which a rotatable mode selection switch provides for switching between pure rotational and pure percussion movements of a working tool. The switching is effected by an axial displacement of a switching sleeve which is associated with a percussion mechanism and surrounds a rotatable guide tubular member connected with a working tool-receiving chuck. An eccentric switching element, which engages the switching sleeve, connects the switching sleeve with the mode selection switch.

German Publication DE 42 06 840 A1 discloses a tool in which an axially displaceable switching sleeve is connected with a guide tubular member, which is connected with a working tool-receiving chuck, for joint rotation therewith. The switching sleeve is displaceable at least between two positions by associated toothing means. Toothing for blocking the rotational movement of the chuck is arranged in the tool housing without a possibility of rotation relative thereto.

In a tool disclosed in European publication EP-O 759 342 A2, in response to actuation of a rotatable mode selection switch, an axially displaceable, spring-biased blocking sleeve blocks rotation of a guide tubular member, which is connected with the chuck, relative to the tool housing. To this end, the blocking sleeve is provided with a radial circumferential toothing that cooperates with radial circumferential mating toothing provided on the guide tubular member.

In a tool disclosed in U.S. Pat. No. 4,763,733, an axially displaceable switching sleeve, which is provided with radial openings over its circumference, is mounted on a guide tubular member, which is connected with the tool chuck, and is connected with the guide tubular member for joint rotation therewith. The blocking of the rotational movement of the chuck relative to the housing is effected with a bolt which is supported in the housing without a possibility of rotation relative thereto and which radially engages, from outside, in the sleeve openings. The displacement of the bolt is effected in response to actuation of a rotatable mode selected switch.

An object of the present invention is to provide reliable means for blocking the rotational movement of a working tool-receiving chuck with respect to a housing of combination electrical hand-held tool.

SUMMARY OF THE INVENTION

This and other objects of the present invention which will become apparent hereinafter, are achieved by providing a combination electrical hand-held tool having a plurality of operational modes and including a housing, a tool spindle rotatably supported in the housing for rotation about a rotational axis, and an outer sleeve arranged coaxially with the tool spindle and connected thereto for joint rotation therewith. A bolt is supported in the housing without a possibility of rotation relative thereto and is displaceable in a direction transverse to the rotational axis for engaging in at least one opening provided in the sleeve at least in one of the operational modes of the electrical tool. A manually actuatable mode selection switch controls displacement of the bolt. A sliding sleeve, which is supported on a drive shaft of the electrical tool, is connected with the bolt for displacing the same in response to actuation of the mode selection switch.

According to the present invention, advantageously, the displacement of the sliding sleeve in effected with a switching element which engages in the sliding sleeve and is displaced manually via the mode selection switch.

In this way, the sleeve and the bolt engaging in the sleeve block the rotation of the tool chuck relative to the housing.

Advantageously, the outer sleeve surrounds the guide tube in which a percussion piston is displaceable for imparting a percussion movement to the tool chuck.

Advantageously, the outer sleeve is provided, at one of its opposite sides, with a bevel gear which is engageable with bevel drive pinion for effecting rotation of the sleeve. The drive pinion is secured on the drive shaft which advantageously extends transverse to the rotational axis of the chuck.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
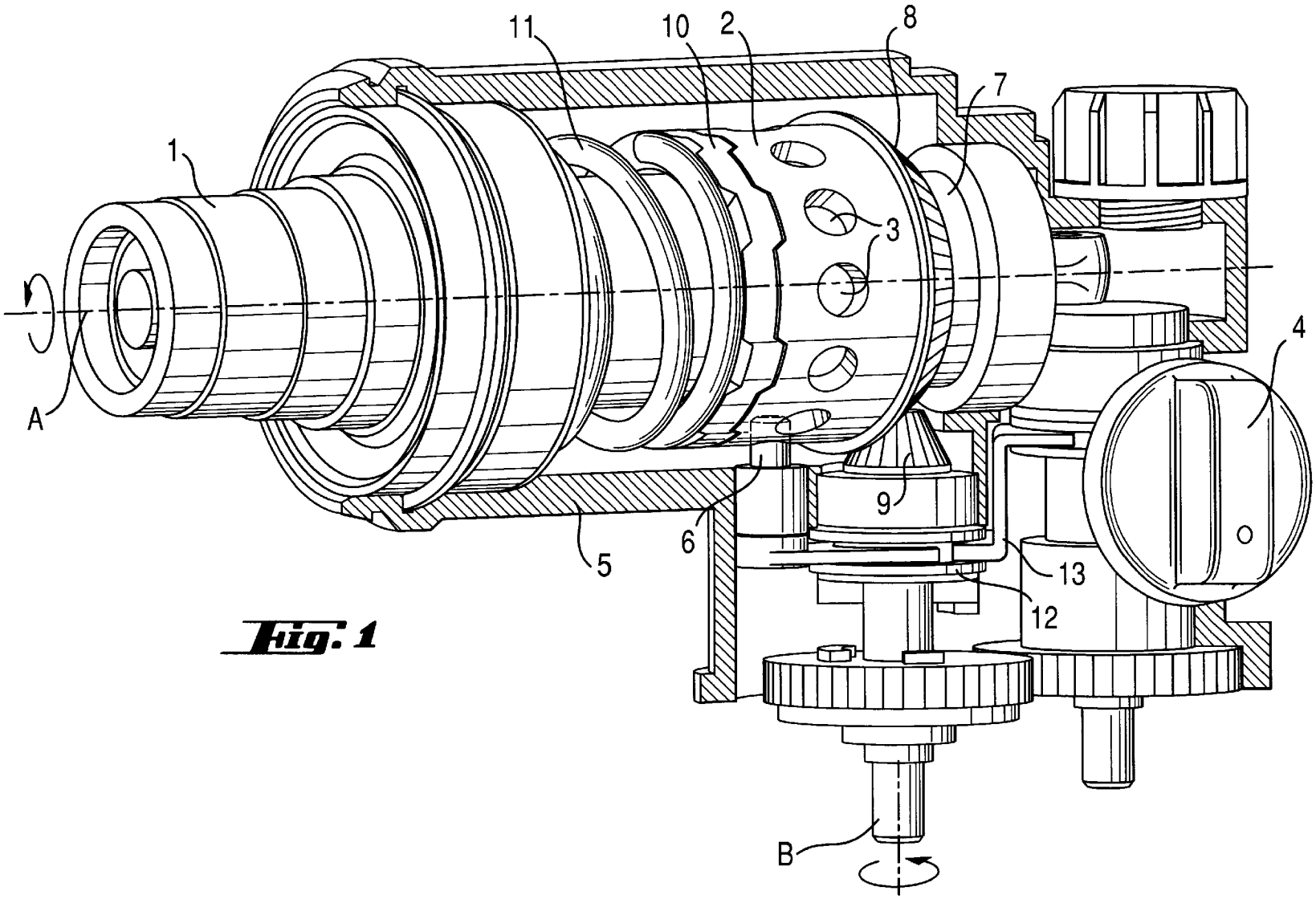
FIG. 1 a perspective, partially cross-sectional view of a portion of a combination electrical hand-held tool according to the present invention with a rotational movement being blocked.

A combination electrical hand-held tool, which is shown in the drawings had several operational modes and includes a tool spindle 1, which rotates about a rotational axis A and which has a chuck (not shown) secured at its front end, and an outer sleeve 2 connected with the spindle 1 for joint rotation therewith. The sleeve 2 has a plurality of radial openings 3 distributed over its circumference. A bolt 6, which is supported in the tool housing 5 without a possibility of rotation relative thereto, is displaceable, in a direction perpendicular to the rotational axis A, into the radial openings 3 of the outer sleeve 2. The displacement of the bolt 6 is controlled by a mode selection switch 4. The outer sleeve 2 surrounds a guide tube 7 within which a percussion piston (not shown) is displaceable. At an end side of the sleeve 2, there is provided a bevel gear 8 which cooperates with an associated, bevel drive pinion 9. The drive shaft B, on which the drive pinion 9 is supported, extends transverse to the rotational axis A. At end side of the sleeve 2 opposite the end side with a bevel gear 8, there is provided a coupling disc 10 formlockingly connected with the guide tube 7 for joint rotation therewith. A compression spring 11 biases the coupling disc 10 axially toward the sleeve 2. The bolt 6 is connected with a sliding sleeve 12 supported on the drive shaft B. The sliding sleeve 12 is connected by a switching element 13 with the mode selection switch 4.

Figure 2:
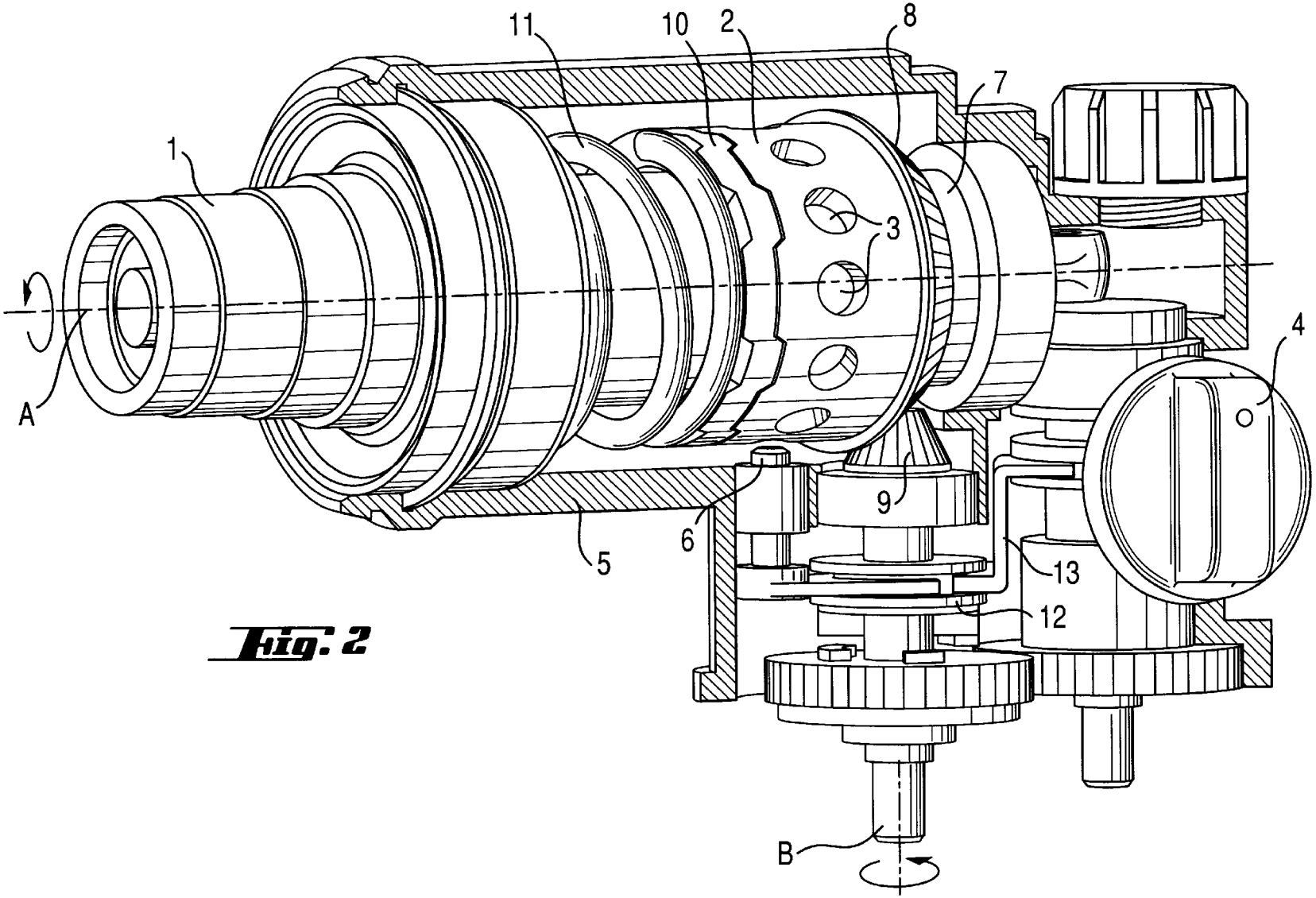
FIG. 2 a view identical to that of FIG. 1 but with the rotational movement being transmitted to the chuck.

FIG. 2 shows a position in which the bolt 6 is disengaged from an opening 3 and does not block rotation of the tool spindle 1 relative to the housing 5. The disengagement of the bolt 6 from the opening 6 is effected by actuation of the mode selection switch 4. With the actuation of the switch 4, the switching element 13 displaces the slide sleeve 12, together with the bolt 6, in a disengagement direction of the bolt 6.

Though the present invention was shown and described with references to the preferred embodiment, such are merely illustrative of the present invention and are not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. An electrical hand-held tool having a plurality of operational modes, comprising a housing (5); a tool spindle (1) rotatably supported in the housing (5) for rotation about a rotational axis (A); an outer sleeve (2) arranged coaxially with the tool spindle (1) and connected thereto for joint rotation therewith, the sleeve (2) having at least one radial opening (3); a bolt (6) supported in the housing (5) without a possibility of rotation relative thereto and displaceable in a direction transverse to the rotational axis (A) for engaging in the at least one opening (3) of the sleeve (2) at least in one of the operational modes of the electrical tool; a manually actuatable mode selection switch (4) for controlling displacement of the bolt (6); a sliding sleeve (12) supported on a drive shaft (B) of the electrical tool and connected with the bolt (6) for displacing same in response to actuation of the mode selection switch (4).

2. An electrical hand-held tool according to claim 1, wherein the sleeve (2) has a plurality of openings (3) distributed over a circumference thereof.

3. An electrical hand-held according to claim 1, further comprising gear means for transmitting rotational movement of the drive shaft (3) to the sleeve (2), the gear means having a bevel gear (8) fixedly connected with the sleeve (2) and a bevel drive pinion (9) supported on the drive shaft (B) and cooperating with the bevel gear (8).

4. An electrical hand-held tool according to claim 1, further comprising a switching element (13) formlockingly engaging the sliding sleeve (12) and connecting the sliding sleeve (12) with the mode selection switch (4).

5. An electrical hand-held tool according to claim 1, further comprising a guide tube (7) in which a percussion piston is displaceable, the sleeve (2) surrounding the guide tube (7).

6. An electrical hand-held tool according to claim 5, further comprising a coupling disc (10) connected with the guide tube (7) for joint rotation therewith and cooperating with the sleeve (2); and a compression spring (11) for biasing the coupling disc (10) into engagement with the sleeve (2).

* * * * *